US006778763B1

(12) United States Patent
Reusche et al.

(10) Patent No.: US 6,778,763 B1
(45) Date of Patent: Aug. 17, 2004

(54) FLOATING WATER DEICER

(75) Inventors: Thomas K. Reusche, Elburn, IL (US); Donald B. Owen, Batavia, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 0 days.

(21) Appl. No.: 10/764,053

(22) Filed: Jan. 23, 2004

Related U.S. Application Data

(60) Provisional application No. 60/442,981, filed on Jan. 27, 2003.

(51) Int. Cl.[7] ..... H05B 3/80
(52) U.S. Cl. ..... 392/499
(58) Field of Search ..... 392/497, 498, 392/499, 501

(56) References Cited

U.S. PATENT DOCUMENTS 2,561,932 A * 7/1951 Landgraf ..... 119/73
4,835,366 A * 5/1989 Owen et al. ..... 392/499
6,597,863 B2 7/2003 Koskey, Jr.

* cited by examiner

*Primary Examiner*—Thor S. Campbell
(74) *Attorney, Agent, or Firm*—McAndrews, Held & Malloy, Ltd.

(57) ABSTRACT

A water deicer for maintaining an opening in a body of water that would otherwise freeze over with ice, includes a water pump having an inlet and an outlet, and a heater. The heater is constructed and positioned to deliver heat to the body of water at or near the water surface. The combination of the heater and the pumped water functions to maintain an opening in the water's surface that would otherwise freeze over with ice.

22 Claims, 5 Drawing Sheets

FLOATING WATER DEICER

RELATED APPLICATIONS

This application relates to and claims priority benefits from U.S. Provisional Patent Application No. 60/442,981 entitled "Floating Water Deicer," filed Jan. 27, 2003, which is incorporated by reference herein in its entirety.

BACKGROUND OF THE INVENTION

Embodiments of the present invention relate to an apparatus for maintaining an opening in the surface of a body of water, such as a pond or livestock watering tank, that would otherwise freeze over with ice.

Many property owners have ponds located within their property (such as a backyard pond). During winter months in colder climates, the ponds tend to freeze over with ice. When the ponds freeze over, toxic gases are trapped under the ice and pose a hazard to fish living within the pond. If the frozen surface is not broken in order to allow toxic gases to escape, the water below the frozen surface may become overly concentrated with nitrates, for example. Thus, the ice typically is broken in order to allow the toxic gases to escape.

In order to gain access to water below the surface for various activities and provide a path for toxic gases to escape, the frozen surface of the water is typically broken, drilled, or the like, in order to provide an accessible path to the water below. However, conventional methods of providing access to the water are typically labor-intensive, time-consuming, and typically do not prevent subsequent freezing.

As an alternative to conventional methods, pond heaters were to maintain an ice-free area within a body of water. However, typical pond heaters are expensive to operate because they operate at approximately 1500 watts or more, and, as such, may be dangerous.

U.S. Pat. No. 6,597,863, entitled "Device for Keeping a Portion of a Body of Water Free from Ice," discloses a device for keeping a portion of a body of water free from ice. The device includes a heating element and a buoyant enclosure. The opening of the device includes a diaphragm with a vent. As such, the opening of the device is small, or covered, thereby obstructing the view of liquid underneath. Thus, it may be difficult to discern whether the device is operating properly by sight alone.

Thus, a need exists for an improved system and method for maintaining an opening in the surface of a body of water.

SUMMARY OF THE INVENTION

Embodiments of the present invention provide a floating water deicer for maintaining an opening in a body of water that would otherwise freeze over with ice. The deicer includes a buoyant support member (or a float) that floats at or near the water's surface. The deicer also includes a water pump having an inlet and an outlet. The pump draws water in through the inlet and expels it through the outlet. The pump is carried by the support member such that the outlet is located at or near the surface of the water. A heater is also carried by the support member. The heater is constructed and positioned to deliver heat to the water at or near the water's surface. The combination of the heater and the pumped water maintains an opening in the water surface that would otherwise freeze over with ice.

In one embodiment, the body of the pump is mounted proximate the support member. A fluid conduit may be connected to the inlet of the pump. The conduit extends downwardly from the water's surface such that water is drawn from a depth where it is warmer than the water at or near the water's surface.

In another embodiment, the body of the pump is suspended below the water's surface, such that the pump's body and inlet are at a location where the water is warmer than the water at or near the surface. In this embodiment, a fluid conduit extends between the pump's outlet and a location at or near the water's surface, such that water expelled through the outlet is discharged at or near the water's surface. The conduit may serve as the means for connecting the pump to the support member, or, alternatively, a separate connection bracket may be provided for this purpose.

The support member may comprise a ring-shaped member having an outer diameter, an inner diameter and a center opening. The heating element may comprise an electric wire heater which extends around the inner diameter of the ring-shaped member. Optionally, the heating element may be a resistive ink heater, a Kapton heater, or various other known heaters. Foil may be used to cover the heater and disperse the heat from the heater over a larger surface area. Optionally, the heating element may be positioned around or over the outer diameter of the ring-shaped member.

Embodiments of the present invention also provide a deicer that includes a heater configured to be disposed near a surface of the water, and a pump having an inlet and an outlet positioned below the heater. The heater substantially surrounds the opening in the body of water, and is adapted to heat at least a portion of the water within the opening. The pump has an inlet and an outlet positioned below the heater. The pump is configured to be submerged within the water, and to pump water below the surface into the opening. The deicer may be configured to float, or to lock into surrounding ice.

Embodiments of the present invention also provide a method of maintaining an opening in a body of water that would otherwise freeze over with ice. The method includes disposing a heater within a floating deicer, heating water positioned within an opening of the floating deicer with the heater; and pumping water below a surface of the water into the opening.

Figure 1:
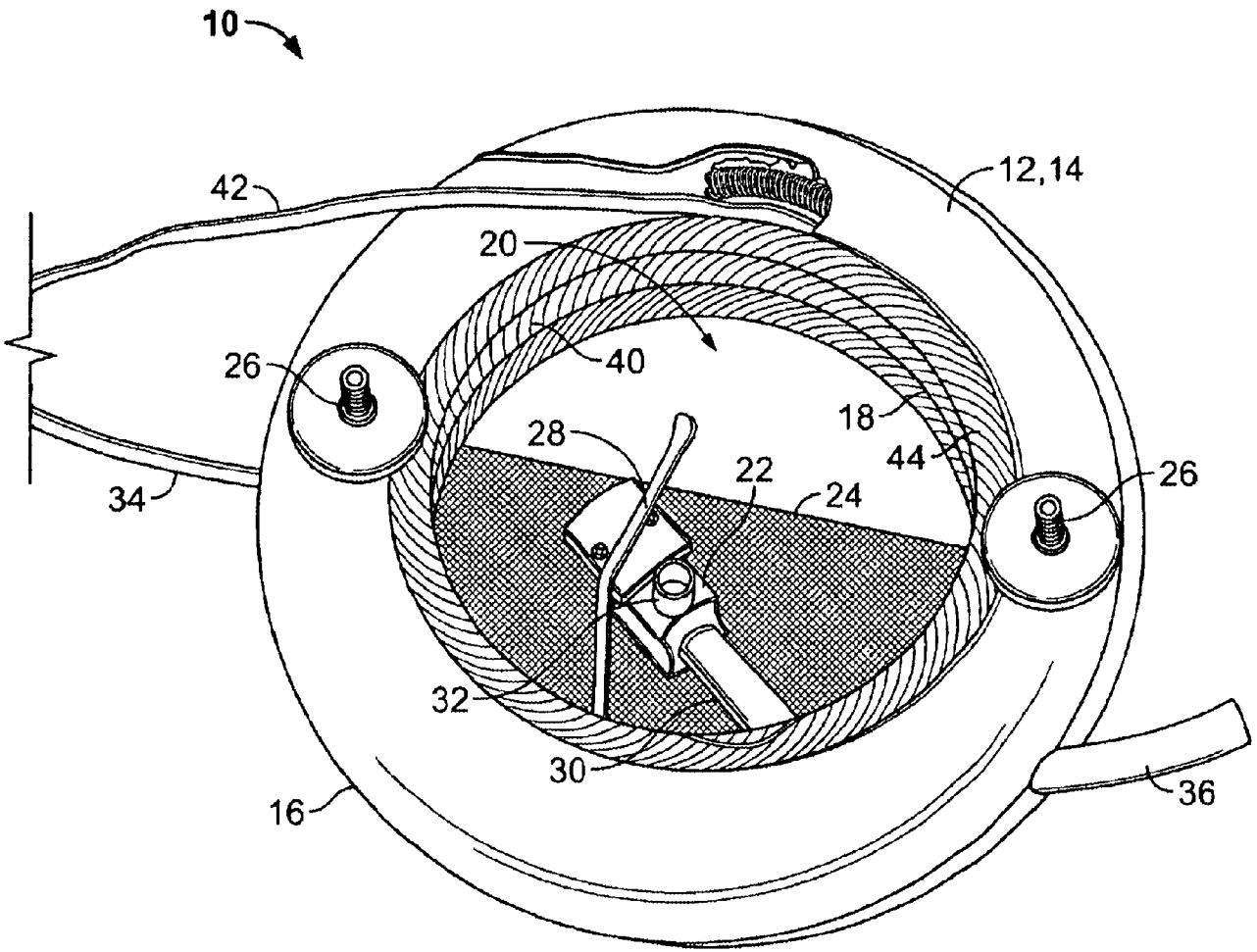
FIG. 1 illustrates a perspective view of a floating deicer according to an embodiment of the present invention.

The following detailed description of the preferred embodiment of the present invention, will be better understood when read in conjunction with the appended drawings.

For the purpose of illustrating the preferred embodiment of the present invention, there is shown in the drawing, an embodiment which is presently preferred. It should be understood, however, that the present invention is not limited to the arrangements and instrumentality shown in the attached drawing.

DETAILED DESCRIPTION OF THE INVENTION

Referring to FIG. 1, a floating deicer 10 according to one embodiment of the present invention comprises a buoyant support member (or float) 12 which is constructed to float at or near the surface a body of water, such as a pond or a livestock watering tank. The support member is formed from a buoyant material such as Styrofoam. In the illustrated embodiment, the support member 12 comprises a ring-shaped member 14 having an outer diameter 16, an inner diameter 18, and a center opening 20. It will be appreciated, however, that the support member 12 can take numerous other forms without departing from the scope of the present invention. For example, the support member 12 may be oval-shaped or rectangular.

The support member 12 carries a submersible pump 22. The pump 22 includes a fluid inlet 30 and a fluid outlet 32. The fluid outlet 32 may include a tube extending outwardly and point towards a sidewall of the support member. A power cord 34 extends from the pump 22 for delivering electricity thereto. During its operation, the pump 22 draws water in through its inlet 30 and expels it through the outlet 32. The pump 22 is carried by the support member 12 such that the pump's outlet is preferably positioned slightly below the water surface. In the illustrated embodiment, the pump 22 is supported in the center opening 20 by a mounting bracket 24 that extends transversely across the center opening 20. The illustrated mounting bracket 24 comprises a plate that is secured to the support member 12 by fasteners 26. A fastener 26 in turn secures the pump to the mounting bracket 24. Optionally, the plate may be integrally formed with the support member 12 Numerous other means could be used to support the pump 22. For example, the pump 22 could be secured directly to the support member 12 by a fastener. Alternatively, the support member 12 could include an integrally formed support bracket. The pump 22 can also be connected to the support member 12 or the mounting bracket 24 in a height-adjustable manner, such that pump (and its outlet) can be height adjusted relative to the water's surface.

A fluid conduit 36, such as a hose, extends downwardly from the pump inlet 30 so that the water is drawn into the pump 22 from below the water surface (and preferably near the bottom of the body of water), where the water is typically warmer than near the surface. As will be appreciated, the length of the conduit 36 varies depending on the application, and in some applications the conduit will be several feet in length. A weight may be positioned on the distal end of the conduit 36 in order to ensure that it hangs down into deeper water.

A heater 40 is carried by the support member for heating the water so as to prevent the water from freezing. In the illustrated embodiment, the heater 40 comprises an electric wire heater that extends around the inner diameter 18 of the support member 12. A power cord 42 extends from the heater 40 for delivering electricity thereto. The heater 40 may be covered with foil 44. The foil 44 serves to protect the heater 40 and also acts to disperse heat from the heater over a greater surface area In this regard, the foil 44 may extend over the top and bottom edges of the ring-shaped support member 12 for transmitting heat to these locations. The heater 40 can, as will be appreciated, take numerous other forms. For example, the heater 40 could be in the form of a cal-rod heater that is suspended below the float. The heater 40 has a relatively low wattage (on the order of 25 to 50 watts) in comparison to most prior floating heaters, which typically have a wattage of between 100 and 1500 watts.

The combination of the heater 40 and the pumped water maintains an open hole in the body of water that would otherwise freeze over with ice. Maintaining an opening in the pond permits gas exchange, which saves the lives of fish living under the ice. This is beneficial, for example, in landscaping ponds. The pump also increases gas exchange, which allows greater gas exchange with a smaller ice opening.

In an alternative embodiment, not shown, the pump 22 is suspended from the buoyant support member 12 such that the pump (and its inlet) are located a substantial distance below the surface of the water (and preferably near the bottom of the body of water). A fluid conduit has one end connected to the pump's outlet and the other end connected to the support member such that water is discharged from the conduit near (and preferably slightly below) the water's surface. The conduit may connect the pump to the buoyant support member. Alternatively, a bracket or other connection means can be provided for supporting the pump. The conduit and or the pump can be connected to the support member in a height-adjustable manner.

Figure 2:
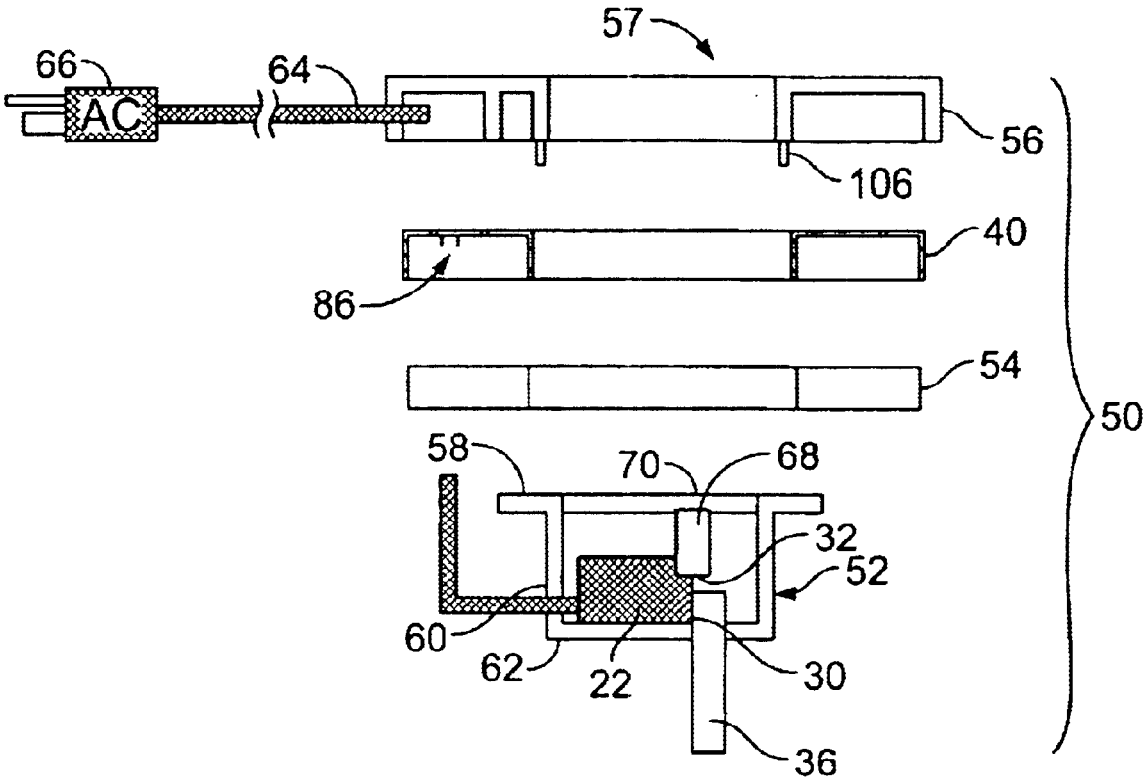
FIG. 2 illustrates an exploded view of a floating deicer according to an embodiment of the present invention.

FIG. 2 illustrates an exploded view of a floating deicer 50 according to an embodiment of the present invention. The deicer 50 includes a pump mounting bracket 52 that securably retains the pump 22 below the surface of the water, a flotation ring 54 having a central opening therein, a heater 40 also having a central opening therein, and a cover 56. A central passage 57 is defined through the flotation ring 54, heater 40 and cover 56.

The pump mounting bracket 52 includes an upper annular portion 58 integrally formed with upright beams 60, which are in turn integrally formed with a pump support base 62. The pump 22 is secured to the support base 62 by way of conventional fasteners, such as screws, bolts, glue, cable-ties, and the like. A water-tight electrical cable 64 is operatively connected to the pump 22 and a power source plug 66, which is in turn configured to operatively mate with an electrical outlet (not shown). Alternatively, the pump mounting bracket 52 may be integrally formed with the heater 40 and/or the cover 56.

The fluid inlet 30 of the pump 22 is connected to the fluid conduit 36 so that the pump 22 may receive water therethrough. The fluid outlet 32 is in turn connected to a fluid conduit 68, which is secured within the pump mounting bracket 52. The fluid conduit 68 includes an outlet 70 that allows fluid to pass from the fluid conduit 68 into the central passage 57. The outlet 70 may be directed toward the sidewalls of the heater 40 and/or cover 56. Thus, when water is pumped into the central opening, the water reflects off the interior sidewalls of the deicer 50, thereby agitating fluid flow within he central opening without splashing.

Figure 3:
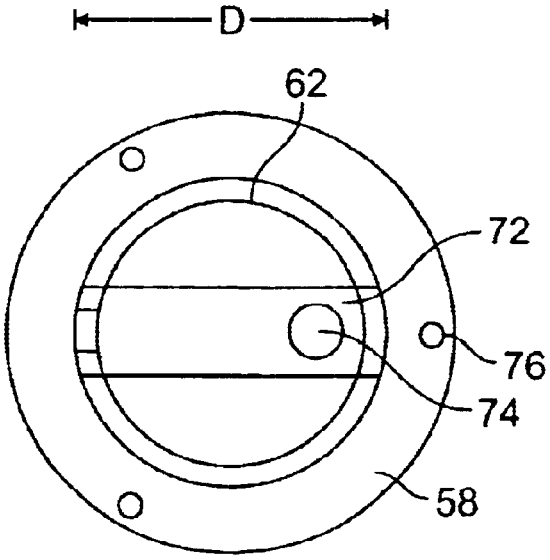
FIG. 3 illustrates a bottom view of a pump mounting bracket according to an embodiment of the present invention.

FIG. 3 illustrates a bottom view of the pump mounting bracket 52. As shown in FIG. 3, the pump mounting bracket 52 includes a central strap 72 that spans an inner diameter D of the support base 62. The central strap 72 may include a channel 74 formed therethrough that secures around the outer diameter of the fluid conduit 36. Optionally, the central strap 72 does not include the channel 74. The upper annular portion 58 may also include fastener holes 76 that are configured to receive and retain securing pins (discussed below) of the cover 56. Alternatively, the upper annular portion 58 may be molded to the cover 56, and thus would not include the fastener holes 76.

Figure 4:
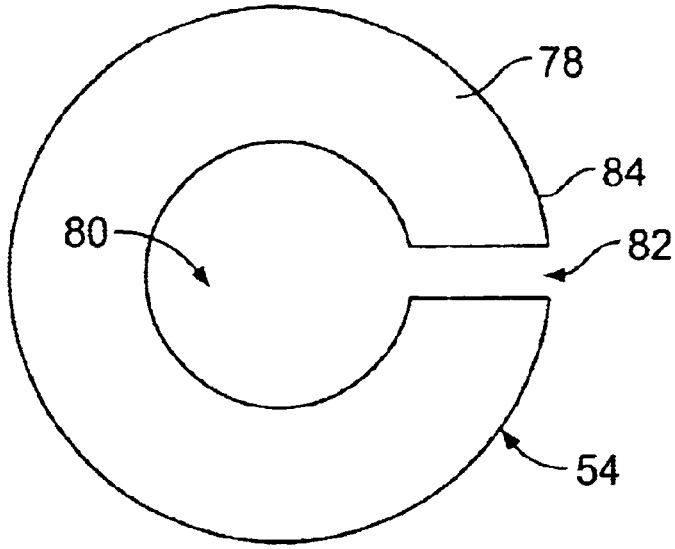
FIG. 4 illustrates a plan view of a floatation ring according to an embodiment of the present invention.

FIG. 4 illustrates a plan view of the flotation ring 54. The flotation ring 54 includes a main body 78 having a central opening 80 formed therethrough. A passage 82 may be formed from an outer edge 84 of the flotation ring 54 to the central opening 80. The flotation ring 54 is formed from a buoyant material such as Styrofoam and is configured to float at or near the surface a body of water, such as a pond or a livestock watering tank. The flotation ring 54 is sized to fit within an interior cavity of the heater 40. While the flotation ring 54 is shown having a ring shape, the flotation ring 54 may be numerous other forms without departing from the scope of the present invention.

Referring again to FIG. 2, the heater 40 includes an interior cavity 86 that is configured to receive and retain the flotation ring 54 therein. Optionally, the flotation ring 54 may be secured within the heater 40 by way of the pump mounting bracket 52 being secured to the cover 56, and thereby sandwiching the flotation ring 54 and the heater 40 therebetween.

Figure 5:
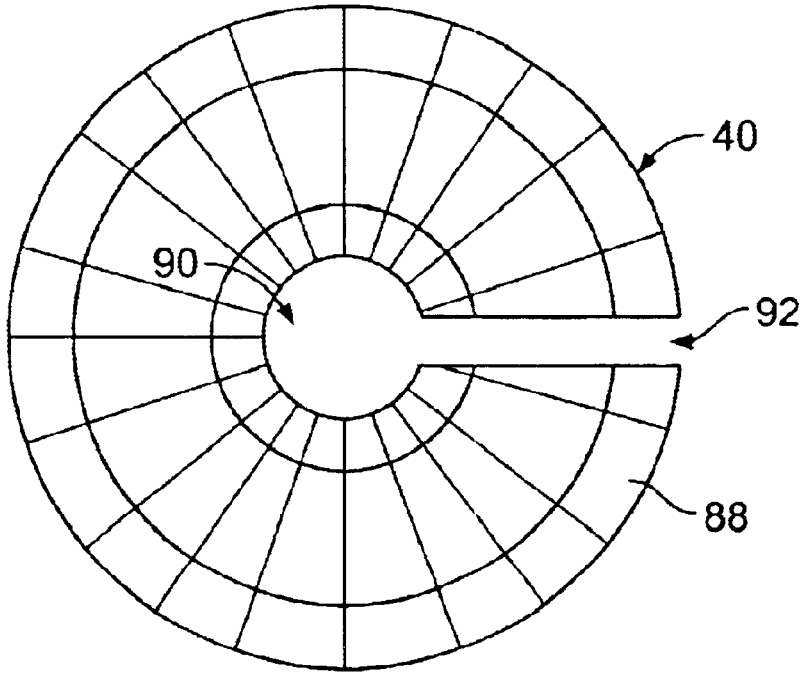
FIG. 5 illustrates a plan view of a heater according to an embodiment of the present invention.

FIG. 5 illustrates a plan view of the heater 40. The flotation ring includes a main body 88 having the inner cavity 86 (shown in FIG. 2) formed therein. Also, the heater 40 includes a central opening 90 and may also include a passage 92 formed therethrough. Optionally, the heater 40 does not include the passage 92, but is rather a contiguous ring. Similar to the flotation ring 54, however, the heater 40 may be formed as various other shapes and sizes. As discussed above with respect to FIG. 1, the heater 40 may be an electric wire heater that extends around the inner diameter of flotation ring 54. A power cord operatively connects to the heater 40. The heater 40 may also be covered with foil.

Figure 6:
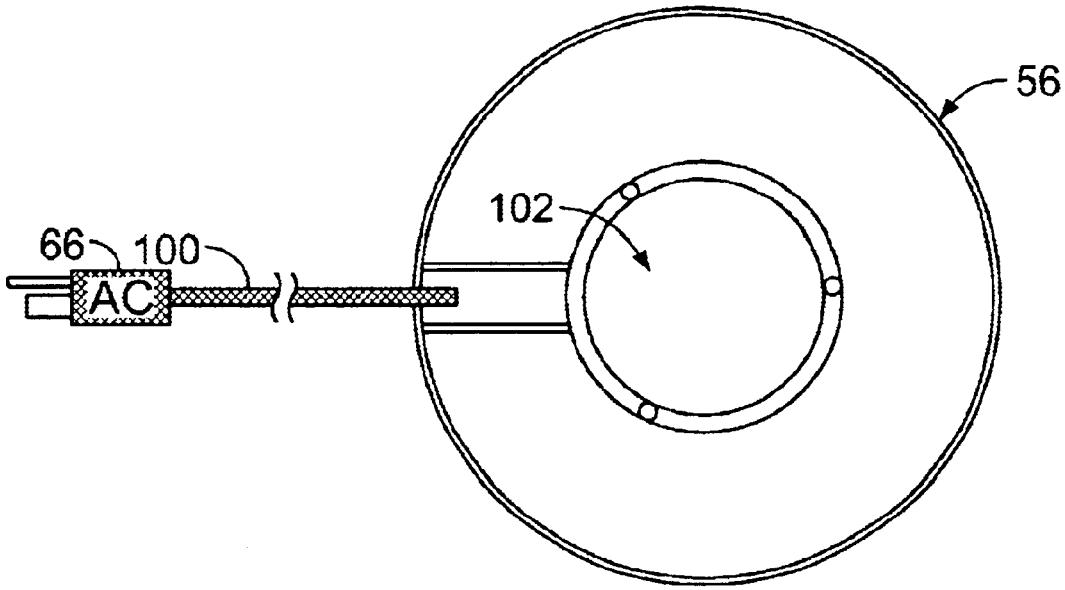
FIG. 6 illustrates a plan view of a cover according to an embodiment of the present invention.

FIG. 6 illustrates a plan view of the cover 56. An electrical cable 100 having the power source plug 66 is positioned through the cover 56 and is configured to supply power to the heater 40 and the pump 22. A central passage 102 is formed through the cover 56.

Figure 8:
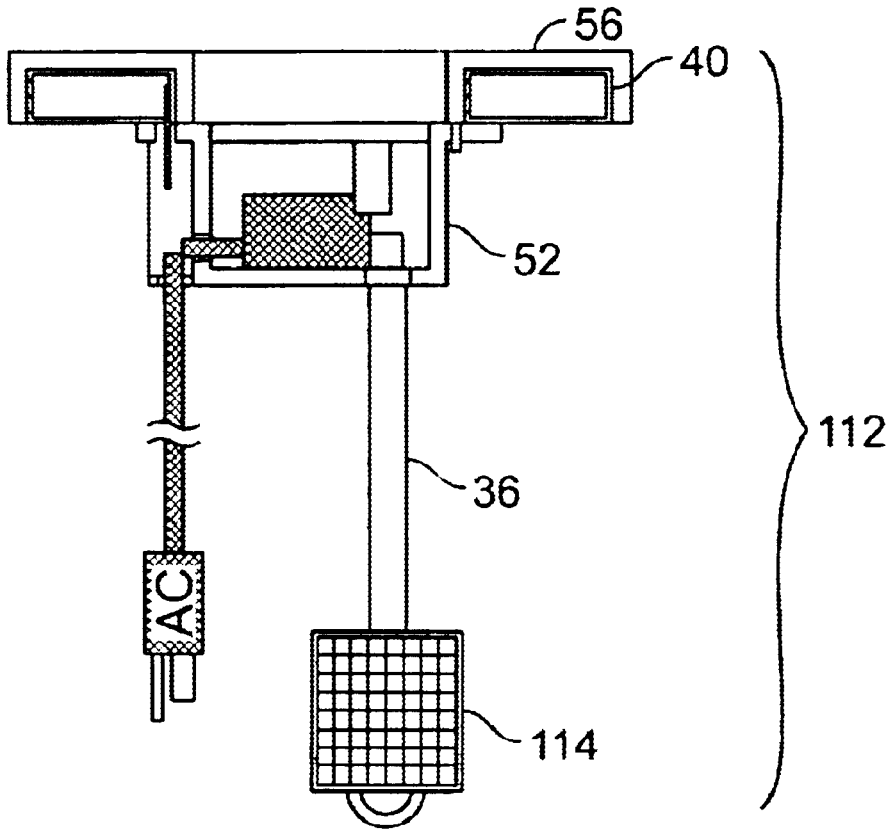
FIG. 8 illustrates a deicer according to an embodiment of the present invention.

Alternatively, the cable 100 may extend downwardly from the cover 56 (as shown in FIG. 8). Thus, the cord 100 would pass through the ice from underneath so that it can extend in a vertical orientation through the ice.

Referring again to FIG. 2, in order to form an assembled deicer 50, the flotation ring 54 and the heater 40 are positioned between the cover 56 and the pump mounting bracket 52. The cover 56 includes securing pins 106 extending downwardly therefrom that align with the fastener holes 76 (shown in FIG. 3) formed through the upper annular portion 58 of the pump mounting bracket 52. The pins 106 do no pass through the main bodies 78 and 88 of the flotation ring 54 and the heater 40, respectively. Instead, the pins 106 pass through the central passage 90 (shown in FIG. 5) of the heater 40. Optionally, the pins 106 may pass directly through the heater 40. The pins 106 are securably retained within the fastener holes 76 in order to securely assemble the deicer 50. The flotation ring 54 and the heater 40 are thus sandwiched between the upper annular portion 58 of the pump mounting bracket 52 and the cover 56. Optionally, various other types of fasteners may be used to assemble the deicer 50. For example, the deicer 50 may be clamped together or the components may be integrally formed with one another.

Figure 7:
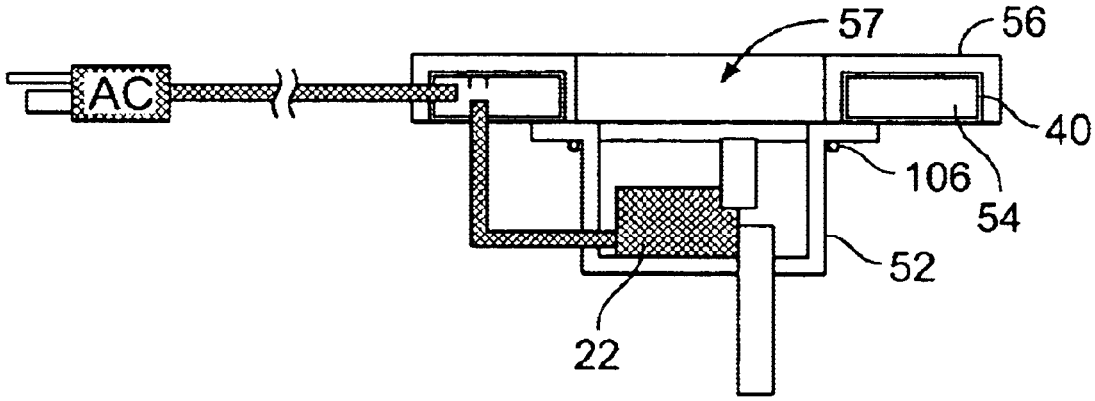
FIG. 7 illustrates an assembled floating deicer according to an embodiment of the present invention.

FIG. 7 illustrates an assembled floating deicer 50. As shown in FIG. 7, the heater 40 and the flotation ring 54 are sandwiched between the cover 56 and the pump mounting bracket 52. Water is pumped by the pump 22 into the central passage 57, while the heater 40 heats the water proximate the central passage 57. The flotation ring 54 provides buoyancy to the deicer 50. The inner walls of the deicer that define the central passage 57 may alternatively taper downwardly and be formed having a bucket-like cross-section.

More than one deicer 50 may be used at one time. In particular, multiple deicers 50 may be linked together through electrical patch cords and powered through a common source of electrical power.

FIG. 8 illustrates a deicer 112 according to an embodiment of the present invention. The deicer 112 includes the pump mounting bracket 52, the heater 40, and the cover 56. The fluid conduit 36 is maintained in a vertical position by way of a weight 114 positioned at a distal end thereof. Further, as shown in FIG. 8, the power cord 100 passes out the underside of the deicer 112.

As discussed above and shown in FIGS. 1–8, embodiments of the present invention provide an improved system and method for maintaining an opening in the surface of a body of water.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed.

What is claimed is:

1. A floating water deicer for maintaining an opening in a body of water that would otherwise freeze over with ice, comprising:

a buoyant support member, the support member being adapted to float at or near the water's surface;

a water pump having an inlet and an outlet, the pump being adapted to draw water in through the inlet and expel it through the outlet, the pump being carried by the support member such that the pump's outlet is located at or near the water's surface, and a heater carried by the support member, the heater being constructed and positioned to deliver heat to the body of water at or near the water's surface, wherein the combination of the heater and the pumped water is adapted to maintain an opening in the water's surface that would otherwise freeze over with ice.

2. The floating water deicer of claim 1, further comprising a fluid conduit extending downwardly from the pump's inlet for drawing water into the pump from a location below the water's surface.

3. The floating water deicer of claim 1, wherein the support member comprises a ring-shaped member having an outer diameter, an inner diameter, and a center opening.

4. The floating water deicer of claim 3, wherein the heating element comprises an electric wire heater that extends around a portion of the ring-shaped member.

5. The floating water deicer of claim 4, further comprising a foil covering the heater.

6. The floating water deicer of claim 3, wherein the pump is disposed within the center opening of the ring-shaped member.

7. A floating water deicer for maintaining an opening in a body of water that would otherwise freeze over with ice, comprising:

a buoyant float;

a water pump having an inlet and an outlet, the pump being suspended below the float such that the pump's inlet is positioned a substantial distance below the water's surface;

a fluid conduit extending between the pumps outlet and a location at or near the water's surface such that water expelled through pump's outlet is discharged at or near the water's surface; and a heater carried by the float, the heater being constructed and positioned to deliver heat to the body of water at or near the water's surface, wherein the combination of the heater and the pumped water functions to maintain an opening the water's surface that would otherwise freeze over with ice.

8. The floating deicer of claim 7, wherein the pump is supported below the float.

9. The floating deicer of claim 7, wherein the float comprises a ring-shaped member having an outer diameter, an inner diameter, and a center opening.

10. The floating deicer of claim 9, wherein the heater comprises an electric wire heater that extends around a portion of the ring-shaped member.

11. The floating deicer of claim 10, further comprising a foil covering the heater.

12. The floating deicer of claim 9, wherein the pump is disposed within the center opening of the ring-shaped member.

13. A deicer for maintaining an opening in a body of water that would otherwise freeze over with ice, comprising:

a heater configured to be disposed near a surface of the water, said heater substantially surrounding the opening in the body of water, and said heater being adapted to heat at least a portion of the water within the opening; and a pump having an inlet and an outlet positioned below said heater, said pump being configured to be submerged within the water, and said pump being adapted to pump water below the surface into the opening.

14. The deicer of claim 13, further comprising:

a flotation ring proximate said heater;

a pump mounting bracket that securely retains said pump below said heater and said flotation ring; and a cover, wherein said heater and said flotation ring are sandwiched between said pump mounting bracket and said cover.

15. The deicer of claim 13, further comprising a fluid conduit extending downwardly from the pump's inlet for drawing water into the pump from a location below the water's surface.

16. The deicer of claim 14, wherein the flotation ring comprises a main body having an outer diameter, an inner diameter, and a center opening.

17. The deicer of claim 16, wherein the heater comprises an electric wire heater that extends around a portion of the flotation ring.

18. The deicer of claim 16, further comprising foil covering the heater.

19. A method of maintaining an opening in a body of water that would otherwise freeze over with ice, comprising:

disposing a heater within a deicer;

heating water positioned within an opening of the deicer with the heater; and pumping water below a surface of the water into the opening.

20. The method of claim 19, further comprising disposing a flotation ring within a cavity of the heater.

21. The method of claim 19, wherein said disposing includes substantially surrounding the opening with the heater.

22. The method of claim 19, further comprising disposing a pump, which is configured to pump water, beneath the heater.

* * * * *